US006883596B2

(12) United States Patent
Kim et al.

(10) Patent No.: US 6,883,596 B2
(45) Date of Patent: Apr. 26, 2005

(54) HEAT EXCHANGER

(75) Inventors: Jeung-Hoon Kim, Suwon (KR); Baek Youn, Suwon (KR); Young-Saeng Kim, Boopyung-Gu (KR); Hwan-Young Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 149 days.

(21) Appl. No.: 10/345,953

(22) Filed: Jan. 17, 2003

(65) Prior Publication Data

US 2004/0050537 A1 Mar. 18, 2004

(30) Foreign Application Priority Data

Sep. 14, 2002 (KR) ..... 2002-55994

(51) Int. Cl.[7] ..... F28D 3/04

(52) U.S. Cl. ..... 165/118; 165/DIG. 171; 261/112.1; 159/13.3

(58) Field of Search ..... 165/115, 118, 165/DIG. 171; 261/112.1; 159/13.3

(56) References Cited

U.S. PATENT DOCUMENTS

| | | | | | |
|---|---|---|---|---|---|
| 1,694,370 | A | * | 12/1928 | Burdick | 62/394 |
| 2,267,569 | A | * | 12/1941 | Loeffler | 66/187 |
| 3,271,969 | A | * | 9/1966 | Lorentzen | 62/98 |
| 4,520,866 | A | * | 6/1985 | Nakajima et al. | 165/115 |
| 4,641,706 | A | * | 2/1987 | Haynie | 165/118 |
| 4,651,819 | A | * | 3/1987 | Yumikura et al. | 165/115 |
| 4,742,869 | A | * | 5/1988 | Nakao et al. | 165/115 |
| 5,004,043 | A | * | 4/1991 | Mucic et al. | 165/118 |
| 5,300,708 | A | * | 4/1994 | Hofs et al. | 568/853 |
| 5,609,296 | A | * | 3/1997 | Imamura et al. | 239/43 |
| 5,893,410 | A | * | 4/1999 | Halbrook | 165/118 |
| 6,453,989 | B1 | | 9/2002 | Watanabe et al. | |
| 6,830,099 | B2 | * | 12/2004 | Moeykens | 165/115 |

FOREIGN PATENT DOCUMENTS

| | | | | |
|---|---|---|---|---|
| JP | 61140789 A | * | 6/1986 | F28D/3/04 |
| KR | 94-13093 | | 6/1994 | |

* cited by examiner

*Primary Examiner*—Allen J. Flanigan
(74) *Attorney, Agent, or Firm*—Staas & Halsey LLP

(57) ABSTRACT

A heater exchanger used to condense a refrigerant in a refrigeration system. The heat exchanger is designed to perform a heat exchanging operation by the use of latent heat of water vaporization, thus having improved heat exchanging efficiency as well as a reduced size. The heat exchanger includes an upper header having a refrigerant inlet port and distributing a refrigerant introduced into the upper header through the refrigerant inlet port, a plurality of heat exchanging tubes connected at upper ends thereof to the upper header and extending in a vertical direction, a lower header connected to lower ends of the heat exchanging tubes and gathering the refrigerant flowing from the heat exchanging tubes, with a refrigerant outlet port formed in the lower header, and a water supply unit assembled with upper portions of external surfaces of the heat exchanging tubes, and feeding water to the tubes to cause water to flow along the external surfaces of the tubes. The water supply unit is a channeled body with the heat exchanging tubes perpendicularly passing the channeled body. The interior of the water supply unit is partitioned into a pressure regulating chamber and a water supply chamber by a partition wall having a plurality of pressure regulating holes. The pressure regulating chamber receives water from the outside, while the water supplying chamber feeds water to the heat exchanging tubes to cause water to flow along the external surfaces of the heat exchanging tubes. A plurality of lower holes are formed at a lower portion of the water supply unit to allow the heat exchanging tubes to perpendicularly pass the water supply unit through the lower holes. Each of the lower holes has a size larger than a cross-sectional size of each of the heat exchanging tubes.

20 Claims, 12 Drawing Sheets

HEAT EXCHANGER

CROSS-REFERENCE TO RELATED APPLICATIONS

This application claims the benefit of Korean Application No. 2002-55994, filed Sep. 14, 2002, in the Korean Industrial Property Office, the disclosure of which is incorporated herein by reference.

BACKGROUND OF THE INVENTION

1. Field of the Invention

The present invention relates, in general, to heat exchangers used in refrigeration systems and, more particularly, to a water-cooled heat exchanger used to condense a refrigerant in such a refrigeration system.

2. Description of the Related Art

As is well known to those skilled in the art, a refrigeration system used with air-conditioning apparatuses includes a compressor, a refrigerant-condensing heat exchanger, a refrigerant-expansion unit, and a refrigerant-evaporating heat exchanger, which are sequentially connected to each other by a refrigerant pipe to create a refrigeration circuit. When the compressor of the refrigeration circuit is operated, a refrigerant circulates through the refrigerant pipe while repeatedly changing its phase by transferring heat to or absorbing heat from the surroundings. The refrigerant system thus cools room air.

In such a refrigeration system used with air-conditioning apparatuses, the refrigerant-condensing heat exchanger comprises a refrigerant-distributing header which distributes an outlet refrigerant of the compressor to a plurality of heat exchanging tubes, and a refrigerant-gathering header which gathers the condensed refrigerant flowing from the heat exchanging tubes, prior to feeding the gathered refrigerant to the refrigerant-expansion unit. A plurality of heat exchanging fins having a thin plate shape are assembled with the heat exchanging tubes so as to enlarge the heat exchanging area, at which outdoor air comes into contact with the heat exchanger. During an operation of such a refrigerant-condensing heat exchanger, outdoor air, which is forced by a blower fan installed adjacent to the heat exchanger, cools the tubes and fins, thus condensing the refrigerant flowing in the tubes. The phase of the refrigerant in the refrigerant-condensing heat exchanger is thus changed from a gas phase into a liquid phase.

However, such a conventional refrigerant-condensing heat exchanger used with refrigeration systems is problematic in that the heat exchanger is cooled only by the air forced by the fan, so the improvement of heat exchanging efficiency is undesirably limited. In addition, the above heat exchanger must have a plurality of heat exchanging fins to enhance the heat exchanging efficiency, so the size of the heat exchanger is undesirably enlarged to accomplish the desired heat exchanging effect. The enlarged size of the heat exchanger undesirably increases the size of a refrigeration system which uses the heat exchanger.

SUMMARY OF THE INVENTION

Accordingly, it is an aspect of the present invention to provide a heat exchanger used with refrigeration systems, which has a reduced size and an improved heat exchanging efficiency.

Additional aspects and advantages of the invention will be set forth in part in the description which follows and, in part, will be obvious from the description, or may be learned by practice of the invention.

The foregoing and/or other aspects of the present invention are achieved by providing a heat exchanger having an upper header having a refrigerant inlet port and distributing a refrigerant introduced into the upper header through the refrigerant inlet port, a plurality of heat exchanging tubes connected at upper ends thereof to the upper header and extending in a vertical direction, a lower header connected to lower ends of the heat exchanging tubes and gathering the refrigerant flowing from the heat exchanging tubes, the lower header having a refrigerant outlet port, and a water supply unit assembled with upper portions of external surfaces of the heat exchanging tubes, and feeding water to the tubes to cause water to flow along the external surfaces of the tubes, the water supply unit comprising a channeled body with the heat exchanging tubes perpendicularly passing the channeled body, an interior of the water supply unit being partitioned into a pressure regulating chamber and a water supply chamber by a partition wall having a plurality of pressure regulating holes, the pressure regulating chamber functioning to receive water from an outside source and the water supplying chamber functioning to feed water to the heat exchanging tubes to cause water to flow along the external surfaces of the heat exchanging tubes, and a plurality of lower holes formed at a lower portion of the water supply unit to allow the heat exchanging tubes to perpendicularly pass the water supply unit through the lower holes, each of the lower holes having a size larger than a cross-sectional size of each of the heat exchanging tubes.

In the heat exchanger, the partition wall partitions the interior of the water supply hole into an upper chamber acting as the pressure regulating chamber and a lower chamber acting as the water supplying chamber.

In an embodiment of the present invention, each of the heat exchanging tubes has a circular cross-section, with a spiral flow guide formed on the external surface of each heat exchanging tube so as to guide a flow of water.

In another embodiment of the present invention, each of the heat exchanging tubes has a circular cross-section with a plurality of linear flow guides axially formed on the external surface of each heat exchanging tube so as to guide a flow of water.

The heat exchanging tubes are plate-shaped multi-channel tubes, with a plurality of partitioned refrigerant channels axially formed in each of the heat exchanging tubes.

Each of the heat exchanging tubes has 1.5–2.5 mm thickness, 5–20 mm width, and 1.27–1.52 mm hydraulic diameter of each of the refrigerant channels.

A plurality of linear flow guides are axially formed on the external surface of each of the heat exchanging tubes so as to guide a flow of water.

The upper header, lower header and water supply unit respectively comprise a plurality of upper headers, lower headers, and water supply units, which are closely arranged in a parallel arrangement, with the heat exchanging tubes being arranged between the upper headers and the lower headers to create a set of heat exchanger modules.

The heat exchanger further comprises a refrigerant inlet pipe having a distributing manifold and being connected at the distributing manifold to the refrigerant inlet ports of the upper headers so as to distribute the refrigerant into the upper headers, a refrigerant outlet pipe having a gathering manifold and being connected at the gathering manifold to the refrigerant outlet ports of the lower headers so as to gather the refrigerant from the lower headers, and a water supply pipe having a water distributing manifold, and being connected to water supply ports of the water supply units so as to distribute water into water supplying chambers of the water supply units.

A reinforcing member is assembled with the external surfaces of the heater exchanging tubes at a position between the upper and lower headers, so as to hold the heat exchanging tubes.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
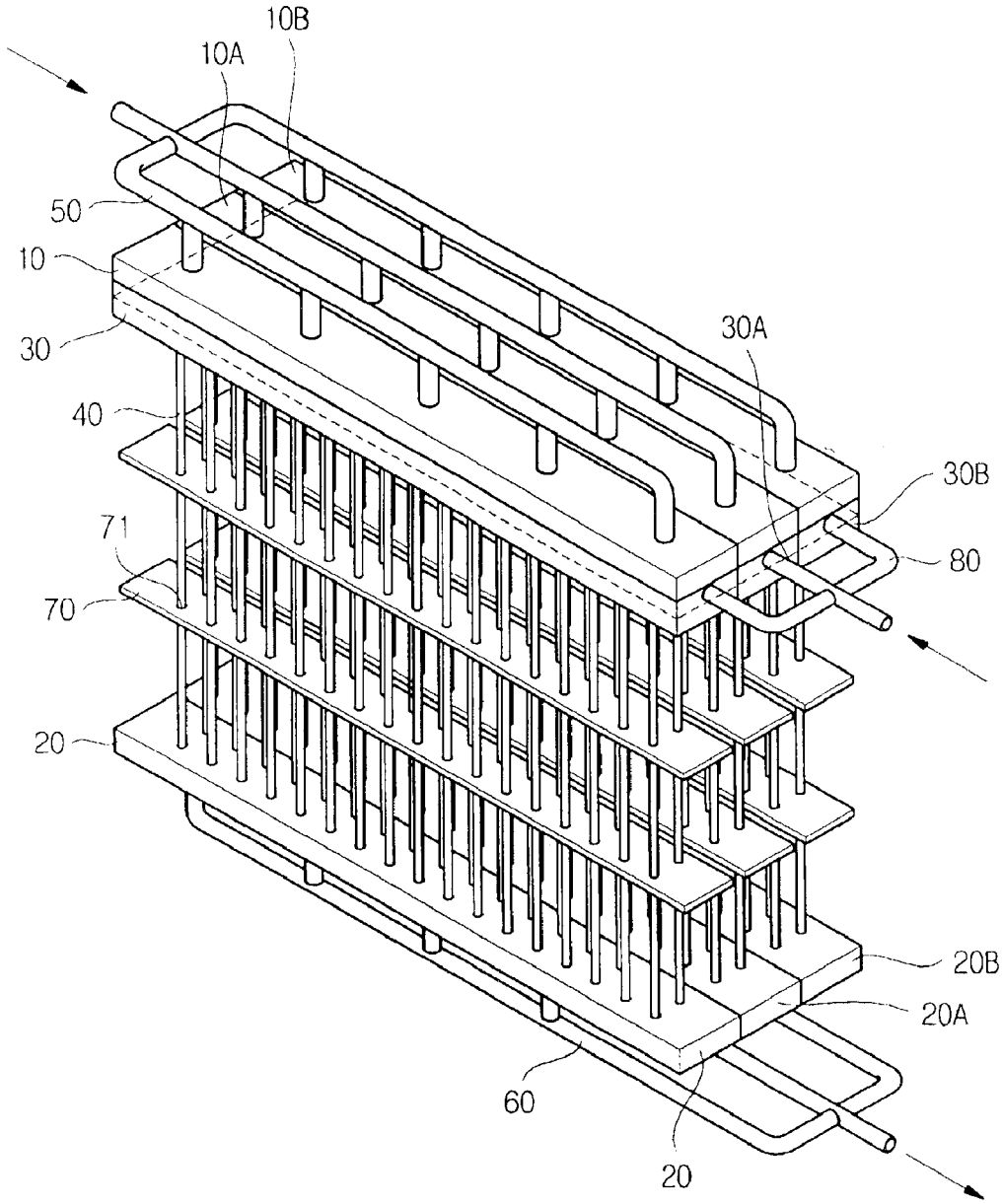
FIG. 1 is a perspective view showing the construction of a heat exchanger in accordance with an embodiment of the present invention.
Figure 2:
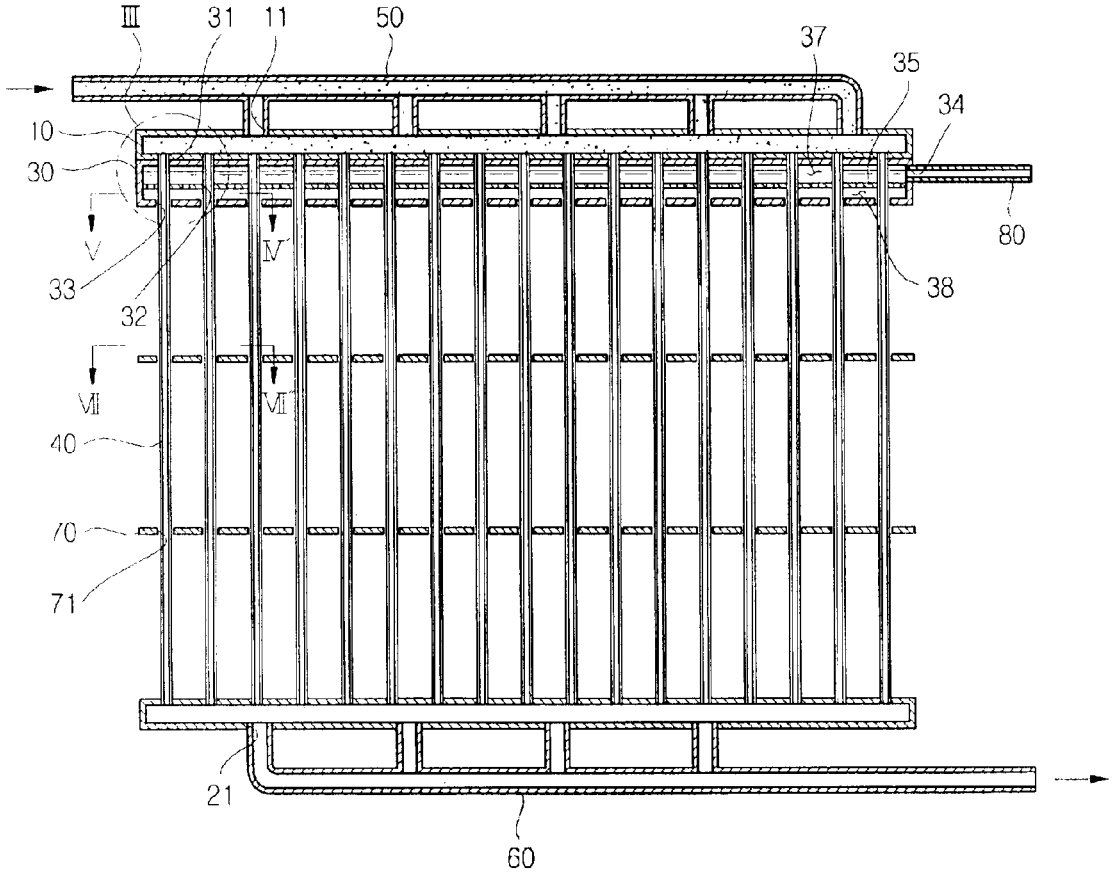
FIG. 2 is a sectional view of the heat exchanger in accordance with the embodiment of FIG. 1.

As shown in FIGS. 1 and 2, the heat exchanger in accordance with an embodiment of the present invention comprises a channeled upper header 10 which distributes an outlet refrigerant of a compressor (not shown), a plurality of heat exchanging tubes 40 through which the distributed refrigerant flows while transferring heat to the outside of the tubes 40 so as be condensed, and a channeled lower header 20 which gathers the condensed refrigerant flowing from the heat exchanging tubes 40. The heat exchanger also includes a water supply unit 30, which is mounted to the lower surface of the upper header 10 and supplies water to the heat exchanging tubes 40 so as to allow the water to flow down along the external surfaces of the tubes 40.

Each of the upper and lower headers 10 and 20 comprises a channeled body, which has a rectangular cross-section, with a refrigerant channel formed in the body. The channeled body of each of the upper and lower headers 10 and 20 is closed at both ends thereof. A plurality of refrigerant inlet ports 11 are formed on the upper wall of the upper header 10 and introduce a refrigerant into the interior of the upper header 10. Connected to the refrigerant inlet ports 11 of the upper header 10 is a refrigerant inlet pipe 50 which extends from the refrigerant outlet of the compressor.

The heat exchanging tubes 40 have a circular cross-section and extend in a vertical direction to have a substantial length capable of allowing the refrigerant to transfer heat to water and air around the tubes 40 while the refrigerant flows through the tubes 40. The above heat exchanging tubes 40 are connected to the lower portion of the upper header 10 at the upper ends thereof, and are connected to the upper portion of the lower header 20 at the lower ends thereof. In such a case, the upper and lower ends of the heat exchanging tubes 40 communicate with the interior of the upper and lower headers 10 and 20, respectively. Therefore, the refrigerant is distributed to the heat exchanging tubes 40 by the upper header 10, and flows through the tubes 40 while transferring heat to water and air around the tubes 40, thus being condensed prior to being gathered by the lower header 20. A plurality of refrigerant outlet ports 21 are formed on the lower wall of the lower header 20 and feed the gathered refrigerant from the lower header 20 to a conventional refrigerant-expansion unit (not shown) of a refrigeration system. Connected to the refrigerant outlet ports 21 of the lower header 20 is a refrigerant outlet pipe 60 which extends to the refrigerant-expansion unit.

Figure 3:
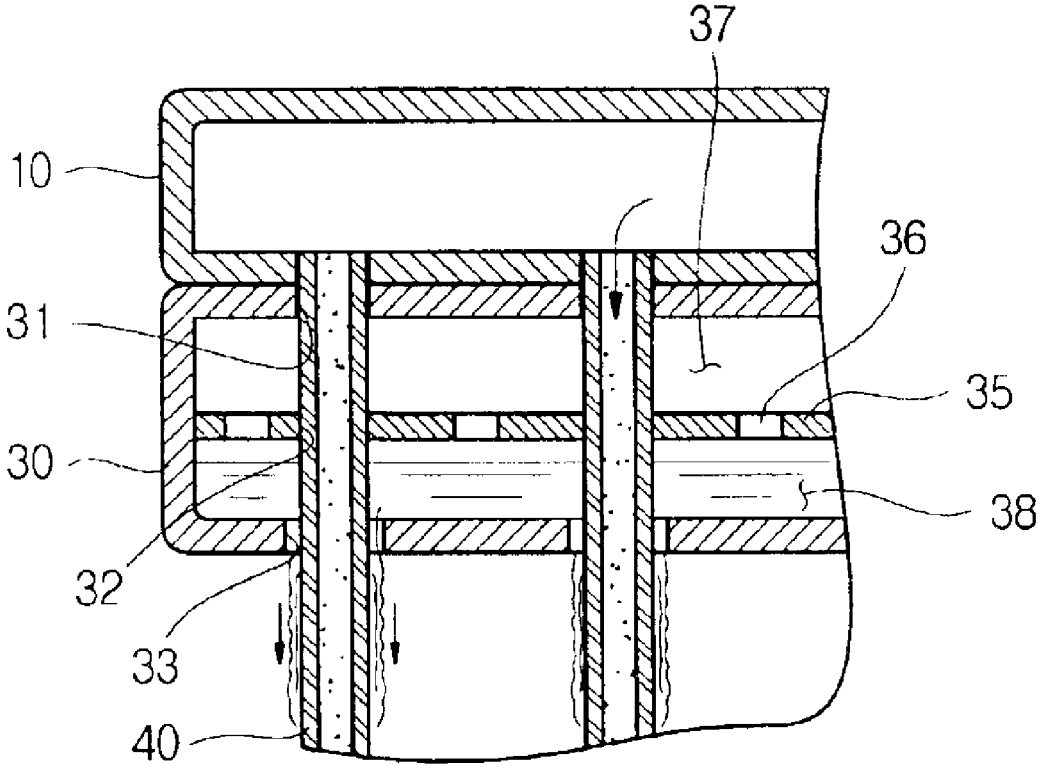
FIG. 3 is a sectional view, showing the construction of the portion "III" of FIG. 2 in detail.

The water supply unit 30, which is mounted to the lower surface of the upper header 10, comprises a channeled body having a hollow rectangular cross-section and defines a water channel. A water supply port 34 is formed at an end of the water supply unit 30. Connected to the water supply port 34 is a water supply pipe 80 which supplies water to the water supply unit 30. The interior of the water supply unit 30, defining the water channel, is horizontally partitioned into upper and lower chambers by a partition wall 35 which horizontally extends in the interior of the water supply unit 30. The upper chamber of the water supply unit 30 acts as a pressure regulating chamber 37, while the lower chamber acts as a water supply chamber 38. The water supply port 34, connected to the water supply pipe 80, is formed at an end of the pressure regulating chamber 37 such that inlet water from the water supply pipe 80 is introduced into the pressure regulating chamber 37. As shown in FIG. 3, a plurality of pressure regulating holes 36 are formed on the partition wall 35 so as to allow water with a controlled pressure and a controlled flow pattern to flow from the pressure regulating chamber 37 into the water supplying chamber 38. Therefore, even when water under high pressure is introduced from the water supply pipe 80 into the pressure regulating chamber 37, the water is appropriately reduced in its pressure while flowing from the pressure regulating chamber 37 into the water supplying chamber 38 through the pressure regulating holes 36 of the partition wall 35. The pressure regulating holes 36 also allow the water to be evenly distributed to the entire area of the water supplying chamber 38.

Figure 4:
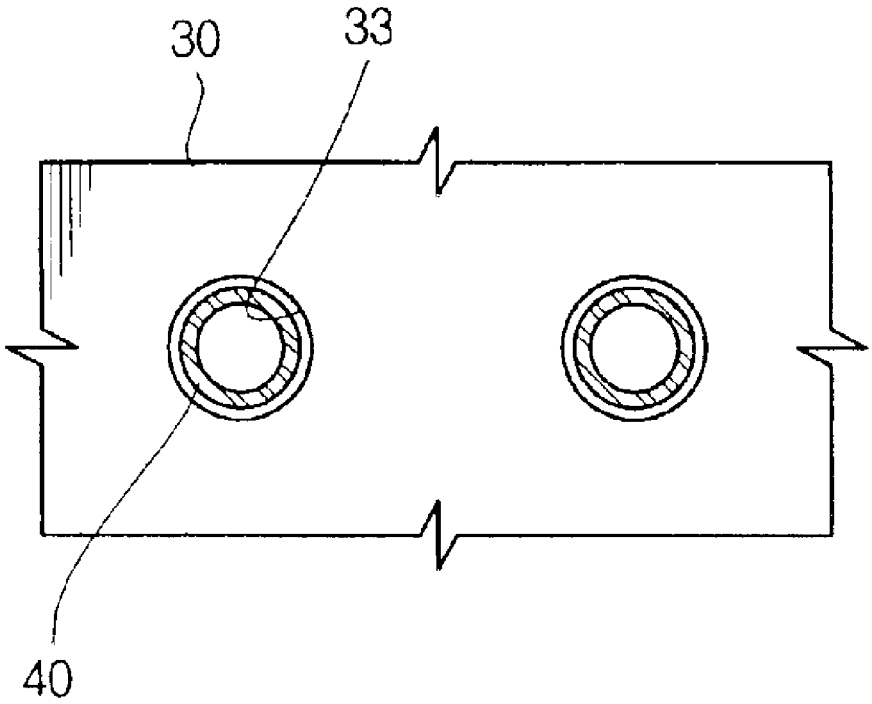
FIG. 4 is a sectional view taken along the line IV–IV' of FIG. 2.

A plurality of upper, middle and lower holes 31, 32 and 33 are formed on the upper wall, the partition wall and the lower wall of the water supply unit 30, respectively, so as to allow the heat exchanging tubes 40 to perpendicularly pass through the water supply unit 30 by way of the upper, middle and lower holes 31, 32 and 33. The cross-sectional areas of the upper and middle holes 31 and 32, formed on the upper and partition walls of the water supply unit 30, respectively, are designed such that the heat exchanging tubes 40 closely pass through the upper and middle holes 31 and 32 while accomplishing a sealing effect at the junctions between the upper and middle holes 31 and 32 and the external surfaces of the tubes 40. Meanwhile, the cross-sectional area of each of the lower holes 33 is larger than that of each of the heat exchanging tubes 40 as shown in FIGS. 3 and 4, thus allowing water from the water supplying chamber 38 to flow down along the external surfaces of the heat exchanging tubes 40.

During a process of fabricating the heat exchangers according to this embodiment of the present invention, It is preferable to design the size and arrangement of the heat exchanging tubes 40, with an inner diameter of about 0.7–2.5 mm, a thickness of about 0.3–1.0 mm, and an interval of about 2–6 mm between neighboring tubes 40.

Figure 5:
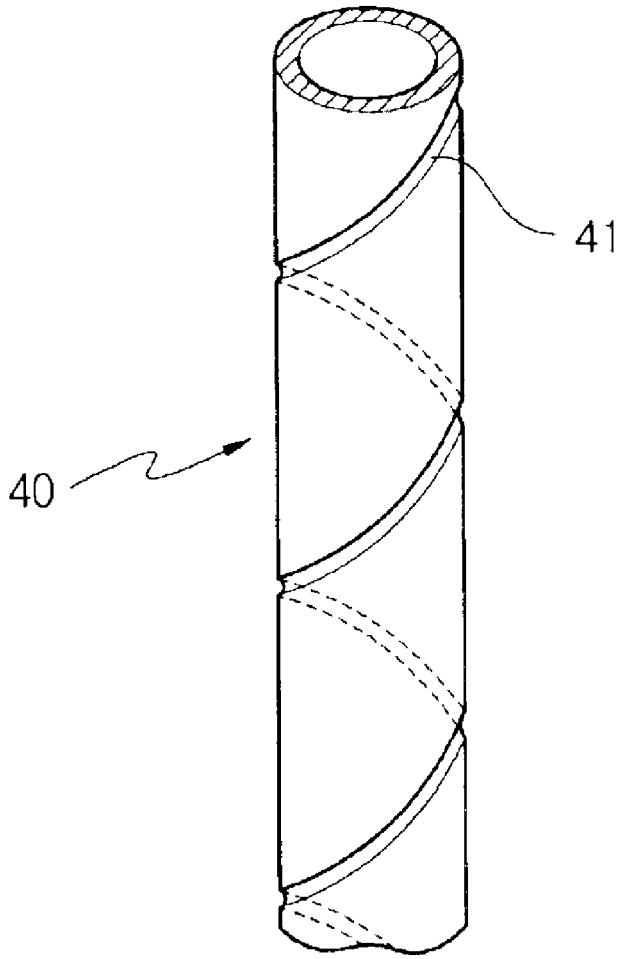
FIG. 5 is a perspective view, showing the construction of a heat exchanging tube included in the heat exchanger in accordance with the embodiment of FIG. 1.
Figure 6:
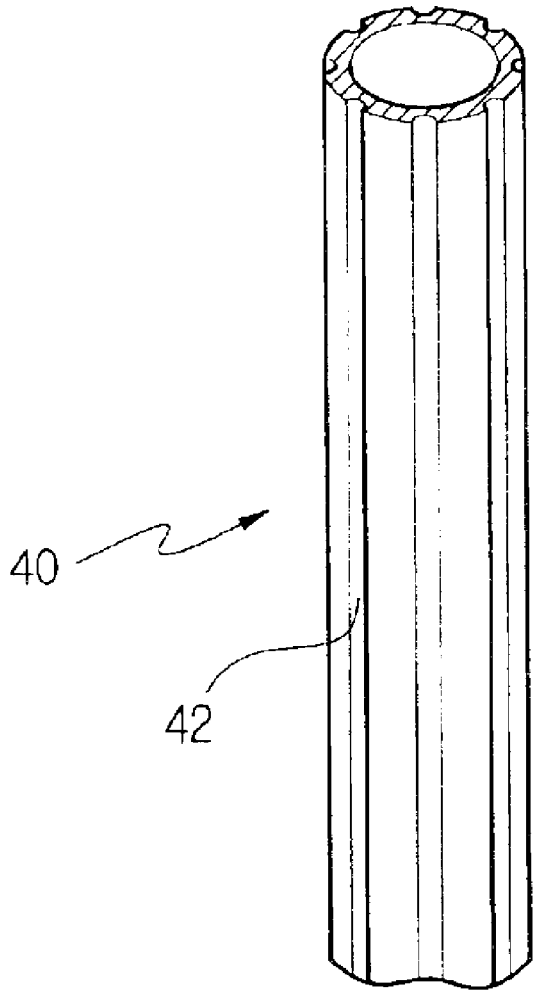
FIG. 6 is a view corresponding to FIG. 5, but showing the construction of a heat exchanging tube in accordance with a modification of the embodiment of FIG.

As shown in FIGS. 5 and 6, a spiral flow guide 41 or a linear flow guide 42 may be formed on the external surface of each heat exchanging tube 40. The spiral or linear flow guides 41 or 42 of the heat exchanging tubes 40 allow water to evenly flow down along the external surfaces of the heat exchanging tubes 40, and enlarge the heat exchanging surfaces of the tubes 40, thus enhancing heat exchanging efficiency of the tubes 40. In the embodiments of the present invention, the spiral flow guide 41 of FIG. 5 may be preferably accomplished by a spiral groove or a spiral ridge formed on the external surface of each heat exchanging tube 40. The linear flow guide 42 of FIG. 6 may be accomplished by a plurality of linear grooves or linear ridges axially extending along the external surface of each heat exchanging tube 40. Alternatively, any other shape may be provided in the heat exchanging tubes 40 which achieve the intended purpose of the present invention.

Figure 7:
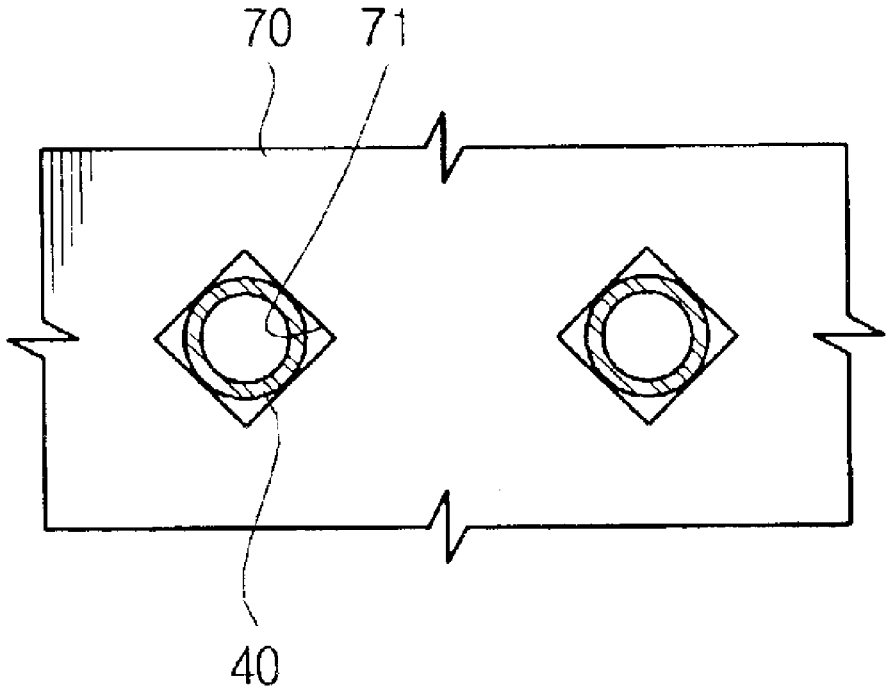
FIG. 7 is a sectional taken along the line VII–VII' of FIG. 2.

In order to prevent an undesired deformation of the heat exchanging tubes 40 caused by an external shock, a plurality of reinforcing members 70 are assembled with the heat exchanging tubes 40 at positions between the upper and lower headers 10 and 20, as shown in FIGS. 1 and 2. Each of the reinforcing members 70 is a flat plate, with a plurality of tube passing holes 71 formed on the plate so as to receive the heat exchanging tubes 40. The tube passing holes 71 of the reinforcing members 70 have a size larger than the outer diameter of the tubes 40. That is, the tube passing holes 71 of the reinforcing members 70 are designed to have a rectangular shape as shown in FIG. 7, such that the four corners of each tube passing hole 71 are spaced apart from the external surface of an associated heat exchanging tube 40 and the edges of the tube passing hole 71 are in contact with the external surface of the tube 40 at four positions. The tube passing holes 71 of the reinforcing members 70 thus stably hold the heat exchanging tubes 40 without allowing an undesired movement of the tubes 40, and let water flow through the gaps between the corners of the tube passing holes 71 and the external surfaces of the heat exchanging tubes 40. Water thus smoothly flows down along the external surfaces of the heat exchanging tubes 40.

As shown in FIG. 1, the heat exchanger according to this embodiment of the present invention includes a plurality of upper headers 10, 10A and 10B which have the same construction and are arranged in a parallel arrangement, a plurality of lower headers 20, 20A and 20B which have the same construction and are arranged in a parallel arrangement, and a plurality of water supply units 30, 30A and 30B, which have the same construction and are arranged in a parallel arrangement. A plurality of heat exchanging tubes 40 are parallely arranged between the upper headers 10, 10A and 10B and the lower headers 20, 20A and 20B while being connected to the upper and lower headers, thus creating a set of heat exchanger modules. A plurality of distributing pipes branch from the refrigerant inlet pipe 50, thus forming a distributing manifold. The distributing pipes of the refrigerant inlet pipe 50 are connected to the refrigerant inlet ports 11 of the upper headers 10, 10A and 10B, and distribute the outlet refrigerant of the compressor to the plurality of upper headers 10, 10A and 10B. In the same manner, a plurality of gathering pipes branch from the refrigerant outlet pipe 60, thus forming a gathering manifold. The gathering pipes of the refrigerant outlet pipe 60 are connected to the refrigerant outlet ports 21 of the lower headers 20, 20A and 20B, and gather the condensed refrigerant from the plurality of lower headers 20, 20A and 20B. The water supply pipe 80 also has a water distributing manifold, which is connected to the water supply ports 34 of the plurality of water supply units 30, 30A and 30B, and distributes water into the water supply units 30, 30A and 30B.

Figure 8:
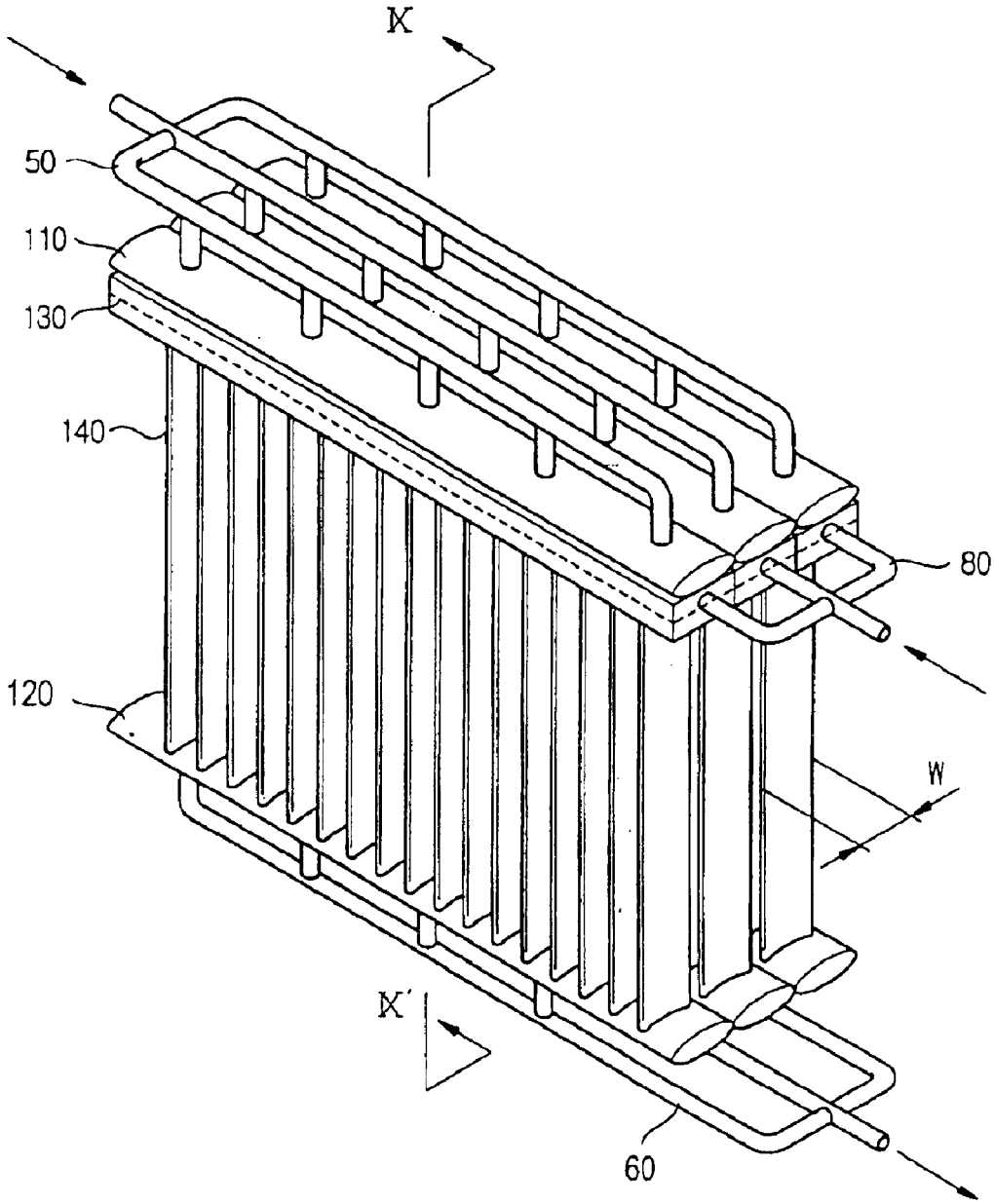
FIG. 8 is a perspective view, showing the construction of a heat exchanger in accordance with another embodiment of the present invention.
Figure 9:
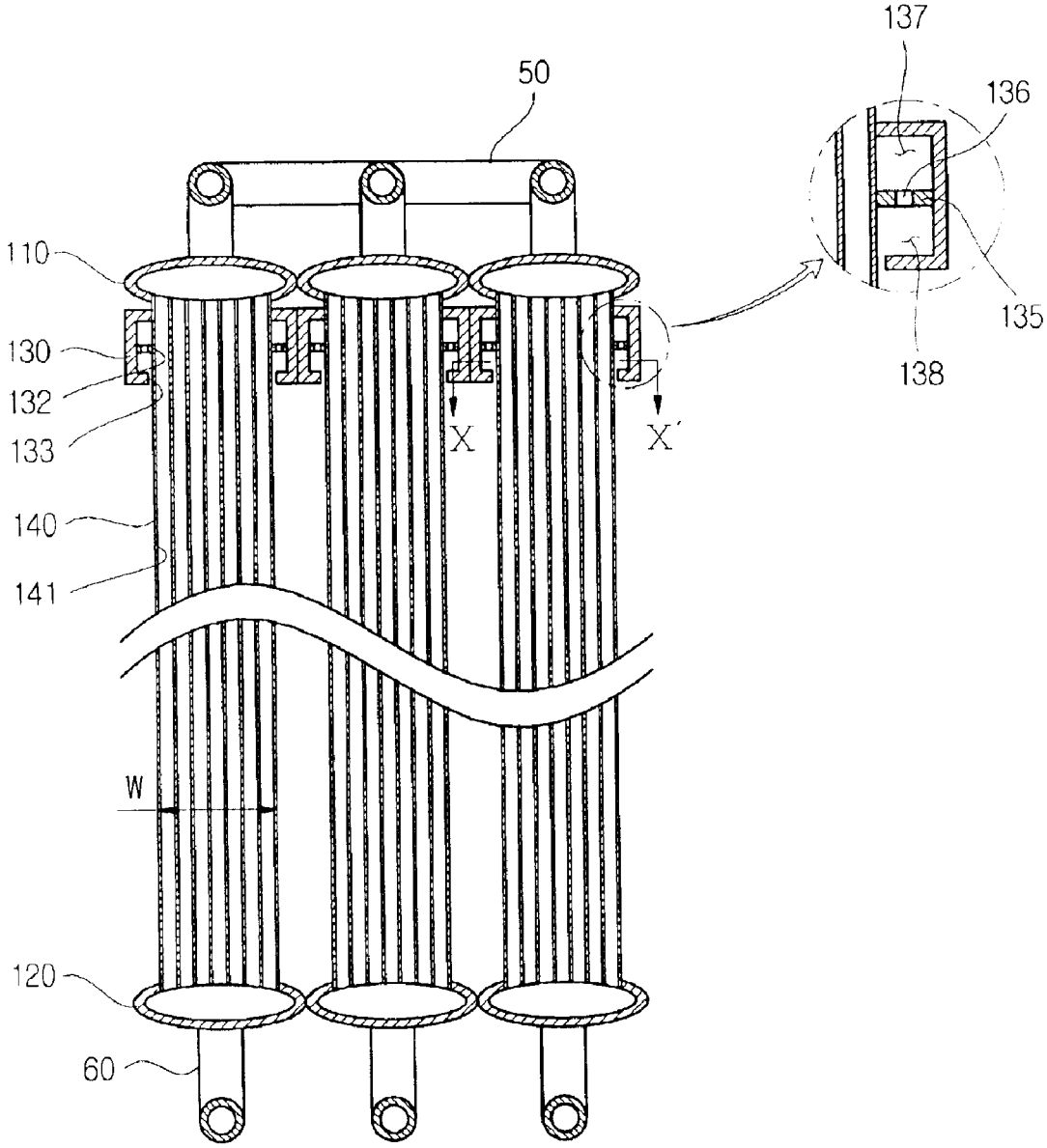
FIG. 9 is a sectional view taken along the line IX–IX' of FIG. 8.
Figure 10:
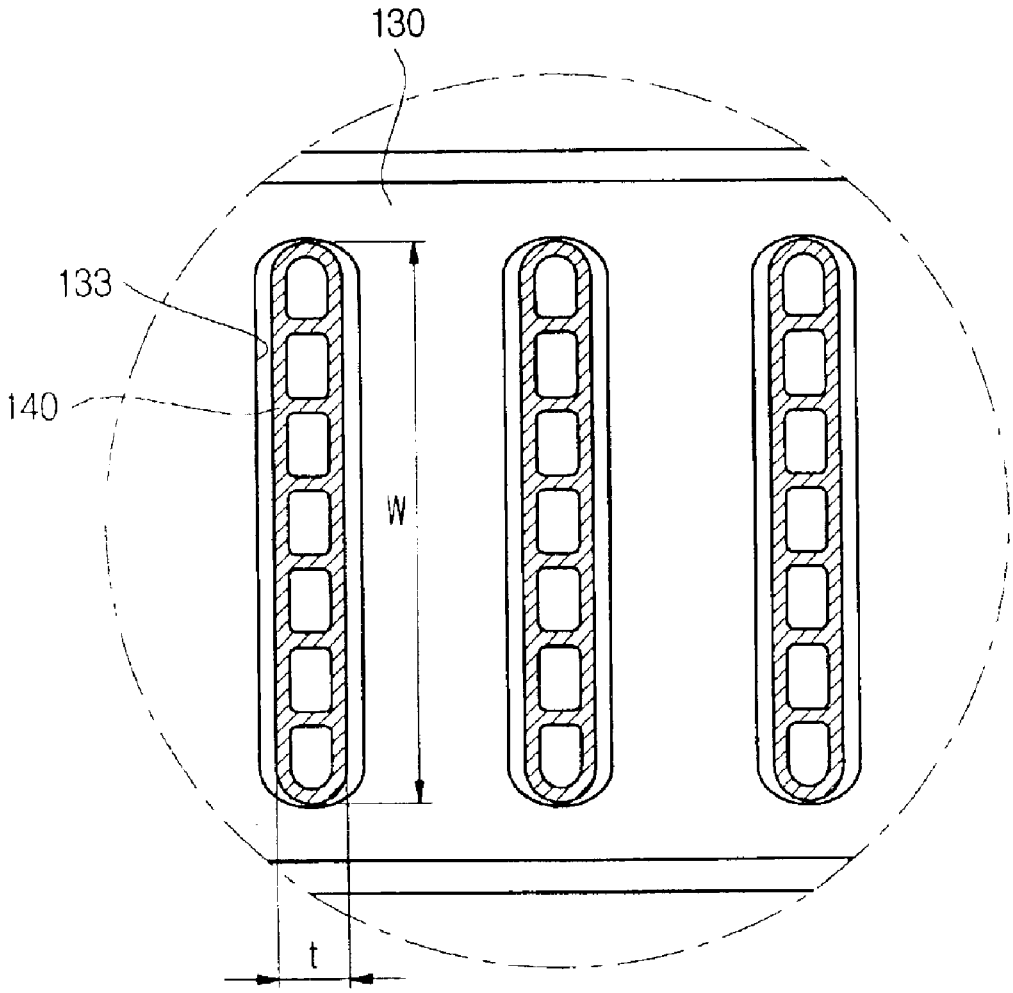
FIG. 10 is a sectional view taken along the line X–X' of FIG. 9.
Figure 11:
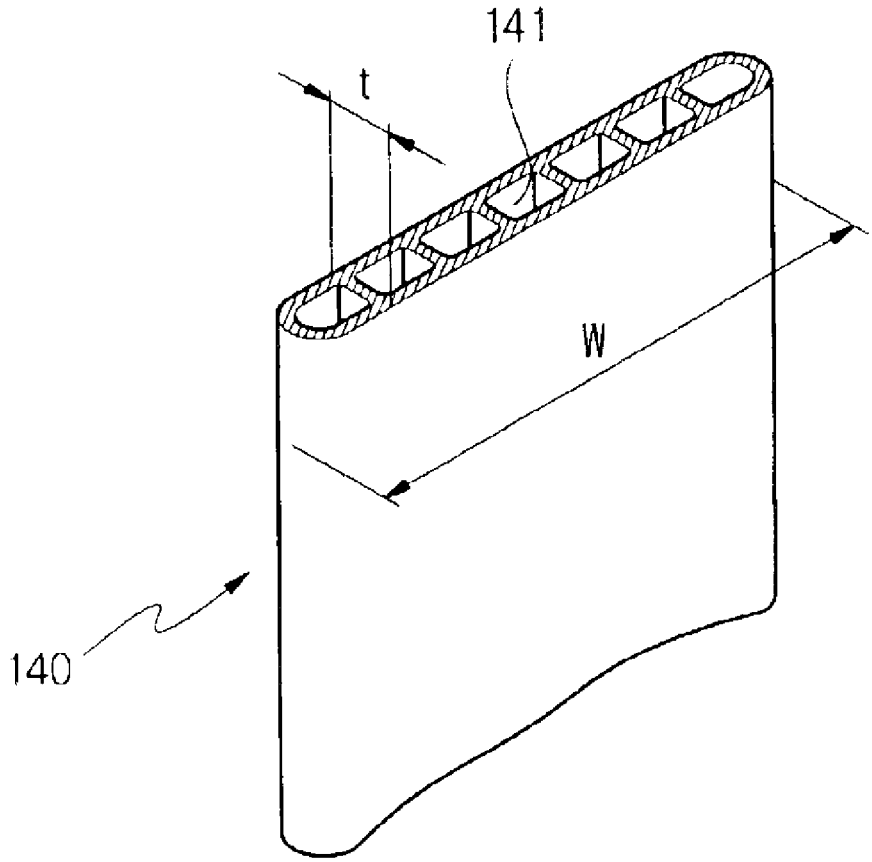
FIG. 11 is a perspective view, showing the construction of a heat exchanging tube included in the heat exchanger in accordance with the embodiment of FIG. 8.

FIG. 8 is a perspective view of the construction of a heat exchanger in accordance with another embodiment of the present invention. The heat exchanger, according to this embodiment, comprises a plurality of heat exchanging tubes 140 formed as plate-shaped multi-channel tubes, and a plurality of upper and lower headers 110 and 120 formed as a channeled body having an elliptical cross-section. The heat exchanging tubes 140 have a longitudinal flat plate profile, with a predetermined thickness "t" and a predetermined width 'w', as best seen in FIGS. 9 to 11. A plurality of partitioned refrigerant channels 141 are axially formed in each tube 140 so the refrigerant flows through the channels 141.

Figure 12:
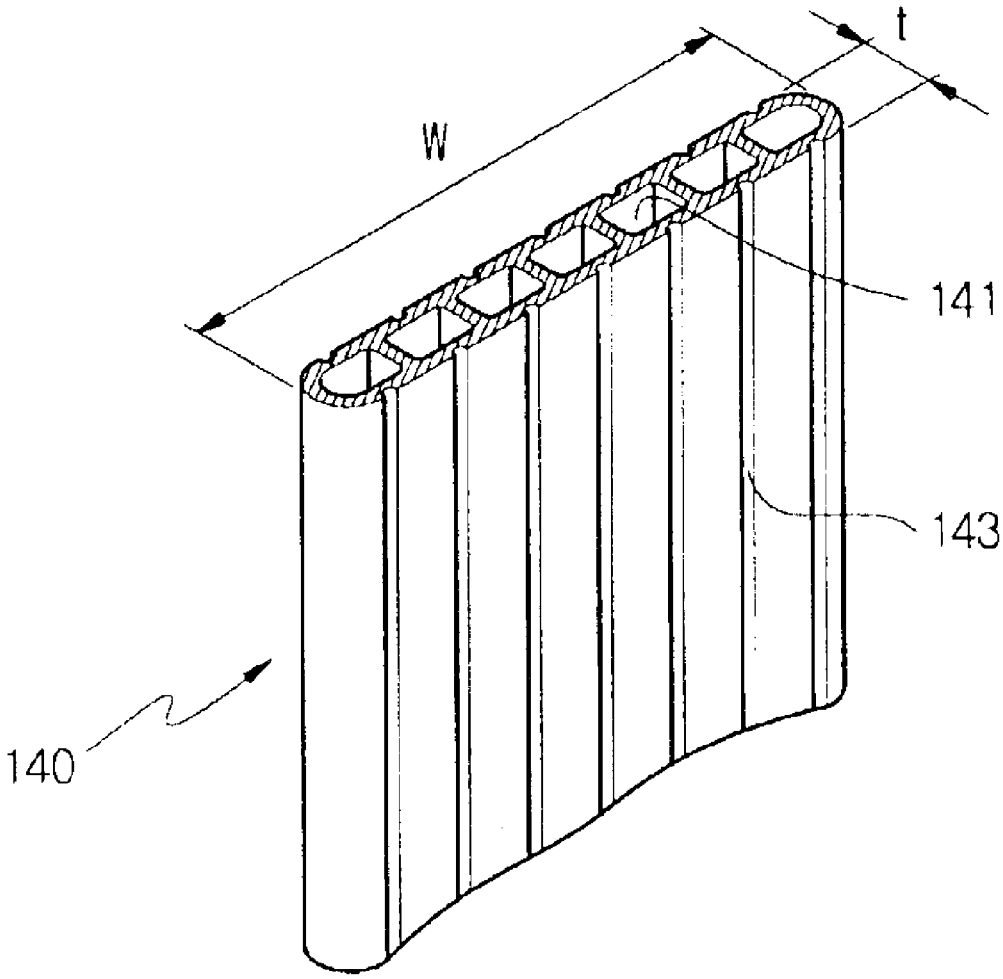
FIG. 12 is a view corresponding to FIG. 11, but showing the construction of a heat exchanging tube in accordance with a modification of the embodiment of FIG. 8.

A water supply unit 130 is mounted to the lower surface of each of the upper headers 110. In the same manner as that described for the previous embodiment, the interior of the water supply unit 130, defining a water channel, is horizontally partitioned into an upper chamber acting as a pressure regulating chamber 137 and a lower chamber acting as a water supply chamber 138, by a partition wall 135 having a plurality of pressure regulating holes 136. As shown in FIG. 10, lower holes 133 of the water supply units 130, through which the heat exchanging tubes 140 pass, are designed such that the width of each lower hole 133 is larger than the thickness "t" of the heat exchanging tube 140. Therefore, water of the water supply units 130 leaks from the units 130 and flows down along the external surfaces of the heat exchanging tubes 140 while being evenly distributed to the entire areas of the external surfaces. As shown in FIG. 12, a linear flow guide 143 is preferably formed on the external surface of each heat exchanging tube 140. The linear flow guide 143 of the heat exchanging tubes 140 allows water, discharged from the water supply unit 130 through the lower holes 133, to evenly flow down along the external surfaces of the tubes 140, and enlarges the heat exchanging surfaces of the tubes 140, thus enhancing heat exchanging efficiency of the tubes 140. The linear flow guide 143 may comprise a plurality of linear grooves or linear ridges which axially extend along the external surface of each heat exchanging tube 140.

During the process of fabricating the heat exchangers according to this embodiment of the present invention, it is preferable to design the size of the heat exchanging tubes 140, with about 1.5–2.5 mm thickness, about 5–20 mm width, and about 1.27–1.52 mm hydraulic diameter of each refrigerant channel 141.

The operation and effect of the heat exchanger according to the embodiments of the present invention will be described herein below.

During an operation of the heat exchanger, high pressure and high temperature gas refrigerant, which flows from the compressor through the refrigerant inlet pipe 50, is distributed to the heat exchanging tubes 40, 140 by the upper headers 10, 110. The distributed refrigerant thus flows to the lower headers 20, 120 through the tubes 40, 140 while transferring heat to water and air around the tubes 40, 140, thus being condensed and changing its gas phase into a liquid phase. The liquid refrigerant from the heat exchanging tubes 40, 140 is gathered in the lower header 20, 120, prior to being fed to a conventional refrigerant-expansion unit (not shown) of the refrigeration system through the refrigerant outlet pipe 60.

During the operation of the heat exchanger, water is fed into the water supply unit 30, 130 through the water supply pipe 80. In such a case, water under a predetermined pressure is primarily introduced into the pressure regulating chamber 37, 137 provided at the upper portion of the water supply unit 30, 130. The water secondarily flows from the pressure regulating chamber 37, 137 into the water supplying chamber 38, 138, provided at the lower portion of the water supply unit 30, 130, through the pressure regulating holes 36, 136 of the partition wall 35, 135. In such a case, water is evenly distributed to the entire area of the water supplying chamber 38, 138 since the water flows to the water supplying chamber 38, 138 through the pressure regulating holes 36, 136 of the partition wall 35, 135. The water under low pressure is discharged from the water supplying chamber 38, 138 through the lower holes 33, 133 of the water supply unit 30, 130, thus slowly flowing down along the external surfaces of the heat exchanging tubes 40, 140. The water absorbs heat from the refrigerant while flowing down along the external surfaces of the heat exchanging tubes 40, 140. In addition, air around the heat exchanger is forced to pass through the gaps between the heat exchanging tubes 40, 140 by a blower fan (not shown), thus absorbing heat from the tubes 40, 140. Therefore, the forced air, which passes through the gaps between the heat exchanging tubes 40, 140, evaporates the water flowing along the external surfaces of the tubes 40, 140, so the tubes 40, 140 are quickly cooled due to latent heat of water vaporization. Heat exchanging efficiency of the heat exchanger, according to the embodiments of the present invention, is thus improved in comparison to conventional heat exchangers.

As apparent from the above description, the present invention provides a water-cooled heat exchanger used to condense a refrigerant in a refrigeration system. In the heat exchanger according to the embodiments of the present invention, water flows along the external surfaces of a plurality of heat exchanging tubes, so heat transferred from the refrigerant flowing through the tubes is absorbed by both the water flowing along the external surfaces of the tubes and air passing through the gaps between the tubes. In such a case, the refrigerant flowing in the heat exchanging tubes is cooled by latent heat of vaporization of water flowing along the external surfaces of the tubes, so heat exchanging efficiency of the heat exchanger, according to the embodiments of the present invention, is thus remarkably improved in comparison to conventional air-cooled heat exchangers.

In addition, due to the improved heat exchanging efficiency, it is possible to reduce the size of the heat exchanger, thus reducing the size of a refrigeration system using the heat exchanger.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heat exchanger, comprising:

an upper header having a refrigerant inlet port and distributing a refrigerant introduced into the upper header through the refrigerant inlet port;

a plurality of heat exchanging tubes connected at upper ends thereof to said upper header and extending in a vertical direction;

a lower header connected to lower ends of said heat exchanging tubes and gathering the refrigerant flowing from the heat exchanging tubes, said lower header having a refrigerant outlet port; and a water supply unit assembled with upper portions of external surfaces of said heat exchanging tubes, and feeding water to said tubes to cause water to flow along the external surfaces of said tubes, said water supply unit comprising:

a channeled body with the heat exchanging tubes perpendicularly passing through the channeled body, an interior of the water supply unit being partitioned into a pressure regulating chamber and a water supply chamber by a partition wall having a plurality of pressure regulating holes, said pressure regulating chamber functioning to receive water from an outside and said water supplying chamber functioning to feed water to said heat exchanging tubes to cause water to flow along the external surfaces of said heat exchanging tubes, and a plurality of lower holes formed at a lower portion of the water supply unit to allow the heat exchanging tubes to perpendicularly pass through the water supply unit by way of the lower holes, each of said lower holes having a size larger than a cross-sectional size of each of the heat exchanging tubes.

2. The heat exchanger according to claim 1, wherein said partition wall partitions the interior of the water supply unit into an upper chamber acting as the pressure regulating chamber and a lower chamber acting as the water supplying chamber.

3. The heat exchanger according to claim 1, wherein each of said heat exchanging tubes has a circular cross-section, with a spiral flow guide formed on the external surface of each heat exchanging tube so as to guide a flow of water.

4. The heat exchanger according to claim 1, wherein each of said heat exchanging tubes has a circular cross-section, with a plurality of linear flow guides axially formed on the external surface of each heat exchanging tube so as to guide a flow of water.

5. The heat exchanger according to claim 1, wherein said heat exchanging tubes are plate-shaped multi-channel tubes, with a plurality of partitioned refrigerant channels axially formed in each of said heat exchanging tubes.

6. The heat exchanger according to claim 5, wherein each of said heat exchanging tubes has 1.5–2.5 mm thickness, 5–20 mm width, and 1.27–1.52 mm hydraulic diameter of each of said refrigerant channels.

7. The heat exchanger according to claim 5, further comprising a plurality of linear flow guides axially formed on the external surface of each of said heat exchanging tubes, respectively, so as to guide a flow of water.

8. The heat exchanger according to claim 1, wherein said upper header, lower header and water supply unit respectively comprise a plurality of upper headers, lower headers, and water supply units, which are closely arranged in a parallel arrangement, with the heat exchanging tubes being arranged between the upper headers and the lower headers to create a set of heat exchanger modules.

9. The heat exchanger according to claim 8, further comprising:

a refrigerant inlet pipe having a distributing manifold and being connected at the distributing manifold to the refrigerant inlet ports of said upper headers so as to distribute the refrigerant into the upper headers;

a refrigerant outlet pipe having a gathering manifold and being connected at the gathering manifold to the refrigerant outlet ports of said lower headers so as to gather the refrigerant from the lower headers; and a water supply pipe having a water distributing manifold, and being connected to water supply ports of said water supply units so as to distribute water into water supplying chambers of the water supply units.

10. The heat exchanger according to claim 1, further comprising a reinforcing member assembled with the external surfaces of said heater exchanging tubes at a position between the upper and lower headers to hold the heat exchanging tubes.

11. The heat exchanger according to claim 10, wherein said reinforcing member is a flat plate with a plurality of tube passing holes formed on said plate to receive the heat exchanging tubes, each of said tube passing holes having a size larger than the cross-sectional size of each of the heat exchanging tubes.

12. The heat exchanger according to claim 1, wherein the channeled body has a hollow rectangular cross-section defining a water channel.

13. The heat exchanger according to claim 1, wherein the water supply unit further comprises:

an upper wall having a plurality of upper holes formed therein;

a lower wall having a plurality of lower holes formed therein; and a plurality of middle holes formed in the partition wall, wherein the heat exchanging tubes perpendicularly pass through the water supply unit by way of the upper, middle and lower holes.

14. The heat exchanger according to claim 13, wherein the cross-sectional areas of the upper and middle holes are designed such that the heat exchanging tubes closely pass through the upper and middle holes which providing a sealing effect at the junctions between the upper and middle holes and the external surfaces of the tubes.

15. The heat exchanger according to claim 14, wherein the heat exchanging tubes have an inner diameter of about 0.7–2.5 mm, a thickness of about 0.3–1.0 mm, and an interval of about 2–6 mm between the neighboring tubes.

16. The heat exchanger according to claim 1, further comprising:

a water supply port formed at an end of the water supply unit; and a water supply pipe supplying water to the water supply unit.

17. The heat exchanger according to claim 1, further comprising a plurality of reinforcing members assembled with the heat exchanging tubes at positions between the upper and lower headers.

18. The heat exchanger according to claim 17, wherein each of the reinforcing members is a flat plate having a plurality of tube passing holes formed on the plate to receive the heat exchanging tubes.

19. The heat exchanger according to claim 18, wherein the tube passing holes of the reinforcing members have a diameter larger than the outer diameter of the heat exchanging tubes.

20. The heat exchanger according to claim 19, wherein the tube passing holes of the reinforcing members have a rectangular shape such that the four corners of each tube passing hole are spaced apart from the external surface of an associated heat exchanging tube and the four edges of each tube passing hole are in contact with the external surface of an associated heat exchanging tube.

* * * * *